US008656749B2

(12) United States Patent
Baba

(10) Patent No.: US 8,656,749 B2
(45) Date of Patent: Feb. 25, 2014

(54) TUBE EXPANDING METHOD FOR HEAT EXCHANGER TUBES AND TUBE EXPANDING APPARATUS FOR HEAT EXCHANGER TUBES

(75) Inventor: Yoshihiro Baba, Tokyo (JP)

(73) Assignee: Hidaka Seiki Kabushiki Kaisha, Tokyo (JP)

( * ) Notice: Subject to any disclaimer, the term of this patent is extended or adjusted under 35 U.S.C. 154(b) by 574 days.

(21) Appl. No.: 12/999,509

(22) PCT Filed: Apr. 9, 2010

(86) PCT No.: PCT/JP2010/056443

§ 371 (c)(1),
(2), (4) Date: Dec. 16, 2010

(87) PCT Pub. No.: WO2010/119818

PCT Pub. Date: Oct. 21, 2010

(65) Prior Publication Data

US 2011/0138872 A1 Jun. 16, 2011

(30) Foreign Application Priority Data

Apr. 16, 2009 (JP) ..... 2009-099724

(51) Int. Cl.
*B21D 11/00* (2006.01)
*B21D 41/02* (2006.01)

(52) U.S. Cl.
USPC ..... 72/318; 72/393; 29/727; 29/890.044

(58) Field of Classification Search
USPC ..... 72/318, 393, 478, 479, 441, 444, 446; 29/723, 726, 726.5, 727, 890.043, 29/890.044, 890.047
See application file for complete search history.

(56) References Cited

U.S. PATENT DOCUMENTS 4,459,917 A * 7/1984 Michael et al. ..... 165/151
4,858,305 A * 8/1989 Gray et al. ..... 29/727

(Continued)

FOREIGN PATENT DOCUMENTS

CN 2551372 Y 5/2003
JP U52-34839 A 3/1977
JP 61-87631 U 6/1986
JP 2-200330 A * 8/1990 ..... B21D 53/08
JP 6-238380 A * 8/1994 ..... B21D 53/08
JP 9-99333 A 4/1997

(Continued)

*Primary Examiner* — Edward Tolan
(74) *Attorney, Agent, or Firm* — Birch, Stewart, Kolasch & Birch, LLP

(57) ABSTRACT

The present invention solves a problem with conventional tube expanding method for heat exchanger tubes that is susceptible, when carrying out tube expansion on U-shaped heat exchanger tubes that have a narrower diameter than in the past and forming flare portions in opening portions that have been subjected to tube expansion, to a buckling phenomenon at boundaries between straight portions and hairpin portions of the heat exchanger tubes or a vicinity thereof.

Opening portions of U-shaped heat exchanger tubes 56 that pass through a fin layer 54 protrude from an upper end surface of the fin layer 54, hairpin portions 56*b* of the heat exchanger tubes 56 protrude from a lower end surface of the fin layer 54, and tube expanding billets 22 are inserted into each opening portion of the heat exchanger tubes 56 to carry out primary tube expansion that expands the diameter of each straight tube portion 56*a* of the heat exchanger tubes 56 to integrate the heat exchanger tubes 56 and fins 50. The primary tube expansion ends with each tube expanding billet 22 inserted into a boundary between the straight tube portion 56*a* and the hairpin portion 56*b* of a heat exchanger tube 56 or the vicinity thereof. The tube expanding billets 22 are then held at the positions where the primary tube expansion ended and flare punches 24 are inserted into the opening portions of the heat exchanger tubes 56 that have been subjected to the primary tube expansion to form flare portions 60 in front end portions of the heat exchanger tubes 56.

6 Claims, 7 Drawing Sheets

(56) References Cited

U.S. PATENT DOCUMENTS

| | | | | |
|---|---|---|---|---|
| 5,210,932 | A * | 5/1993 | Tokura | 29/727 |
| 5,806,173 | A * | 9/1998 | Honma et al. | 29/727 |
| 7,117,584 | B2 * | 10/2006 | Nakadeguchi et al. | 29/727 |
| 8,276,261 | B2 * | 10/2012 | Baba | 29/727 |

FOREIGN PATENT DOCUMENTS

| | | | |
|---|---|---|---|
| JP | 09-099334 | A | 4/1997 |
| JP | 9-141363 | A | 6/1997 |
| JP | 9-206861 | A | 8/1997 |
| JP | 2008-100251 | A | 5/2008 |

* cited by examiner

TUBE EXPANDING METHOD FOR HEAT EXCHANGER TUBES AND TUBE EXPANDING APPARATUS FOR HEAT EXCHANGER TUBES

TECHNICAL FIELD

The present invention relates to a tube expanding method for heat exchanger tubes and a tube expanding apparatus for heat exchanger tubes.

BACKGROUND ART

When manufacturing a heat exchanger used in an air conditioner or the like, as depicted in FIG. 5A, a U-shaped heat exchanger tube 106 is normally inserted into a plurality of collar-equipped holes that are formed in each fin 100 of a fin layer produced by stacking a plurality of fins 100.

Since gaps exist between the inserted heat exchanger tube 106 and the inner wall surfaces of the collar-equipped holes 102, primary tube expansion is carried out by inserting a tube expanding billet 108 depicted in FIG. 5A into the heat exchanger tube 106 to expand straight portions 106*a* of the heat exchanger tube 106 and thereby integrate the heat exchanger tube 106 with the fins 100. When doing so, a hairpin portion 106*b* of the heat exchanger tube 106 that protrudes from a lower end surface of the fin layer 104 is supported by a support portion 116.

In addition, a front end portion of a flare punch 110 depicted in FIG. 5A is inserted into front end portions of the heat exchanger tube 106 that has been subjected to primary tube expansion to carry out secondary tube expansion that further increases the diameter of the front end portions of the heat exchanger tube 106 that has been subjected to primary tube expansion and the vicinity thereof and thereby form expanded-diameter portions 112 and also form flare portions 114 in front end portions of the expanded-diameter portions 112.

As depicted in FIG. 5B, one end portion of a curved connecting portion 120 for connecting to an adjacent U-shaped heat exchanger tube 106 is inserted into an expanded-diameter portion 112 and a flare portion 114 that have been formed in this way.

As one example, a tube expanding apparatus 200 depicted in FIG. 6 and disclosed in Patent Document 1 given below is known as a tube expanding apparatus that carries out tube expansion on the heat exchanger tube 106 depicted in FIG. 5. The tube expanding apparatus 200 depicted in FIG. 6 is equipped with a pressing plate 206 to which rear end portions of a plurality of mandrels 202, 202 are attached and which is provided so as to be capable of being raised and lowered in the up-down direction by cylinder apparatuses 204, 204 as driving means, a flare platform 210 that is suspended from the pressing plate 206 by rod members 208, 208, balancers 212, 212 that are provided below the flare platform 210, contact the flare platform 210 that has been lowered together with the pressing plate 206, and support the flare platform 210 at a predetermined position, and a contact platform 216 that is provided at a predetermined position on a support structure 214 that extends upward from the flare platform 210 so as to contact the lowered pressing plate 206 in a state where the flare platform 210 is being supported at a predetermined position by the balancers 212, 212.

A tube expanding billet 108 as depicted in FIG. 5A is attached to each front end portion of the mandrels 202, 202 and flare punches 110 as depicted in FIG. 5A are attached to the flare platform 210.

BACKGROUND ART DOCUMENT

Japanese Laid-Open Patent Publication No. H09-99333

SUMMARY OF THE INVENTION

According to the tube expanding apparatus 200 depicted in FIG. 6, the pressing plate 206 is lowered by the cylinder apparatuses 204, 204 to insert the tube expanding billets 108 into the U-shaped heat exchanger tubes 106 that have been disposed below the flare platform 210 and have been inserted into the collar-equipped holes 102 of the fins 100 that form the fin layer 104 to carry out primary tube expansion that expands the straight portions 106*a* of the heat exchanger tubes 106 and thereby integrates the heat exchanger tubes 106 and the fins 100 as depicted in FIG. 7A. When doing so, the flare platform 210 is supported by the balancers 212, 212 at a predetermined position and as depicted in FIG. 5A, the front ends of the flare punches 110 attached to the flare platform 210 are positioned at opening portions of the heat exchanger tube 106 that has been subjected to primary tube expansion or the vicinity thereof.

As depicted in FIG. 7A, when each tube expanding billet 108 reaches a predetermined position in the straight portion 106*a* of a heat exchanger tube 106, the pressing plate 206 contacts the contact platform 216 and the flare platform 210 is pressed downward via the contact platform 216 and the support structure 214 with a greater force than the balancers 212, 212. This means that the flare punches 110 and the tube expanding billets 108 are simultaneously pressed, and as depicted in FIG. 7B, once each tube expanding billet 108 has been pressed inside the hairpin portion 106*b* and primary tube expansion has ended, the flare punches 110 form the expanded-diameter portions 112 and the flare portions 114 in the front end portions of the heat exchanger tube 106.

According to the tube expanding apparatus 200 depicted in FIG. 6, it is possible to smoothly carry out tube expansion on a comparatively wide heat exchanger tube 106.

In the field of heat exchangers used in air conditioners and the like, the miniaturization of air conditioners and the like in recent years has led to demand for miniaturization of heat exchangers. This means that it has become necessary to use heat exchanger tubes 106 with a narrower diameter than in the past as the heat exchanger tubes 106.

However, when tube expansion was carried out using the tube expanding apparatus 200 depicted in FIG. 6 on heat exchanger tubes 106 with a narrower diameter than in the past and flare portions were formed at the opening portions that have been subjected to tube expansion, it was discovered that a phenomenon called buckling tends to occur at the boundaries between the straight portions 106*a* and the hairpin portions 106*b* of the heat exchanger tubes 106 or the vicinity thereof.

The present invention aims to provide a tube expanding method for heat exchanger tubes and a tube expanding apparatus for heat exchanger tubes that solve the problem with a conventional tube expanding method for heat exchanger tubes and a conventional tube expanding apparatus for heat exchanger tubes which are susceptible, when carrying out tube expansion on U-shaped heat exchanger tubes that have a narrower diameter than in the past and forming flare portions in opening portions that have been subjected to tube expansion, to a buckling phenomenon at boundaries between straight portions and hairpin portions of the heat exchanger tubes or the vicinity thereof, and therefore avoid buckling and the like even when carrying out tube expansion on U-shaped heat exchanger tubes that have a narrower diameter than in the past and forming flare portions in opening portions that have been subjected to the tube expansion.

As a result of investigating how to solve the problem described above, the present inventors found that when primary tube expansion ends when tube expanding billets that have been inserted into U-shaped heat exchanger tubes reach boundaries between straight portions and hairpin portions of the heat exchanger tubes or a vicinity thereof, by holding the tube expanding billets at the positions where the primary tube expansion ended and inserting flare punches into opening portions of the heat exchanger tubes that have been subjected to primary tube expansion to form flare portions, it is possible to prevent buckling and the like from occurring even when tube expansion is carried out on U-shaped heat exchanger tubes that have a narrower diameter than in the past and flare portions are formed in the opening portions of the heat exchanger tubes.

That is, as a means of solving the problem described above, it is possible to propose a tube expanding method for heat exchanger tubes, including steps of: inserting U-shaped heat exchanger tubes into each of a plurality of insertion holes formed in each fin of a fin layer in which a plurality of fins are stacked so that opening portions of each heat exchanger tube protrude from an upper end surface of the fin layer and a hairpin portion of each heat exchanger tube protrudes from a lower end surface of the fin layer; carrying out primary tube expansion where a tube expanding billet is inserted into each opening portion of the heat exchanger tubes to expand the diameter of each straight portion of each heat exchanger tube and integrate the heat exchanger tubes and the fins and ending the primary tube expansion with each tube expanding billet inserted into a boundary between the straight portion and the hairpin portion of each heat exchanger tube or a vicinity thereof; holding the tube expanding billets at positions where the primary tube expansion ended and inserting flare punches into the opening portions of the heat exchanger tubes that have been subjected to the primary tube expansion to form flare portions in front end portions of the heat exchanger tubes.

As another means of solving the problem described above, it is possible to propose a tube expanding apparatus for heat exchanger tubes including: a pressing plate that has rear end portions of a plurality of mandrels, which have tube expanding billets attached to front end portions thereof, attached thereto and is provided so as to be capable of being raised and lowered in an up-down direction by driving means; a flare platform that is suspended from the pressing plate by rod members and has flare punches attached thereto, the flare punches forming flare portions in opening portions of U-shaped heat exchanger tubes that have been inserted into each of a plurality of insertion holes formed in respective fins of a fin layer in which a plurality of fins are stacked and that protrude from an upper end surface of the fin layer; and a balancer that is provided below the flare platform, contacts the flare platform when the flare platform has been lowered together with the pressing plate that is lowered by driving the driving means, and supports the flare platform at a predetermined position, wherein the driving means of the pressing plate is adjusted so that when the pressing plate is lowered in a state where the flare platform is supported by the balancers at a predetermined position and the tube expanding billets, which carry out primary tube expansion where straight portions of the heat exchanger tubes are expanded to integrate the heat exchanger tubes with the fins, reach boundaries between the straight portions and hairpin portions of the heat exchanger tubes or a vicinity thereof and the primary tube expansion ends, lowering of the pressing plate stops at a position where the pressing plate does not press the flare platform, and wherein the tube expanding apparatus further comprises lowering means that is operable when the lowering of the pressing plate has stopped, to hold the tube expanding billets at positions where the primary tube expansion ended and lower the flare platform to which the flare punches are attached so as to form flare portions in front end portions of the heat exchanger tubes on which the primary tube expansion has ended.

Effect of the Invention

Normally, for U-shaped heat exchanger tubes, hairpin portions that have been bent by machining will be hardened by the bending process and will therefore become harder than straight portions that have not been subjected to any machining.

Also, with a conventional tube expanding method, when a tube expanding billet has reached a predetermined position in a straight portion of a heat exchanger tube, the tube expanding billet and the flare punch are simultaneously pressed. This means that stress due to the tube expanding billet and stress due to the flare punch are simultaneously applied to a boundary between the straight portion and the hairpin portion of the heat exchanger tube or a vicinity thereof.

It is believed that a heat exchanger tube with a narrower diameter than in the past is unable to withstand such stresses and is susceptible to buckling and the like.

With the tube expanding method and the tube expanding apparatus provided by the present inventors, when forming a flare portion in an opening portion of a heat exchanger tube that has been subjected to primary tube expansion, the tube expanding billet is held at the position where the primary tube expansion ended and only the flare punch is inserted into the opening portion of the heat exchanger tube. This means that only stress due to the flare punch is applied to the boundary between the straight portion and the hairpin portion of the heat exchanger tube or a vicinity thereof.

In addition, when doing so, the boundary between the straight portion and the hairpin portion of a heat exchanger tube or a vicinity thereof is reinforced by the tube expanding billet that is positioned at the boundary between the straight portion and the hairpin portion of the heat exchanger tube or a vicinity thereof.

In this way, according to the tube expanding method and the tube expanding apparatus provided by the present inventors, when forming a flare portion in an opening portion of a heat exchanger tube that has been subjected to primary tube expansion, only the flare punch is inserted into the opening portion of the heat exchanger tube while the boundary between the straight portion and the hairpin portion of the heat exchanger tube or a vicinity thereof is being reinforced by the tube expanding billet.

As a result, it is possible to reduce the stress applied to the boundary between the straight portion and the hairpin portion of the heat exchanger tube that is reinforced by the tube expanding billet or a vicinity thereof and therefore possible to carry out tube expansion without causing buckling of a heat exchanger tube that has a narrower diameter than in the past.

BEST MODE FOR CARRYING OUT THE INVENTION

Figure 1A:
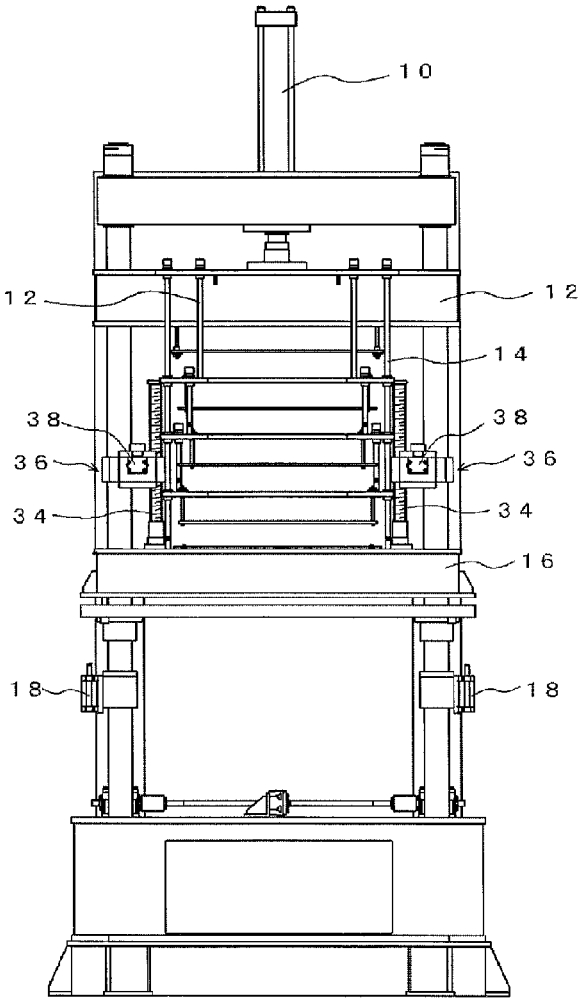
FIG. 1A and FIG. 1B are a front view and a side view depicting one example of a tube expanding apparatus provided by the present inventors.
Figure 1B:
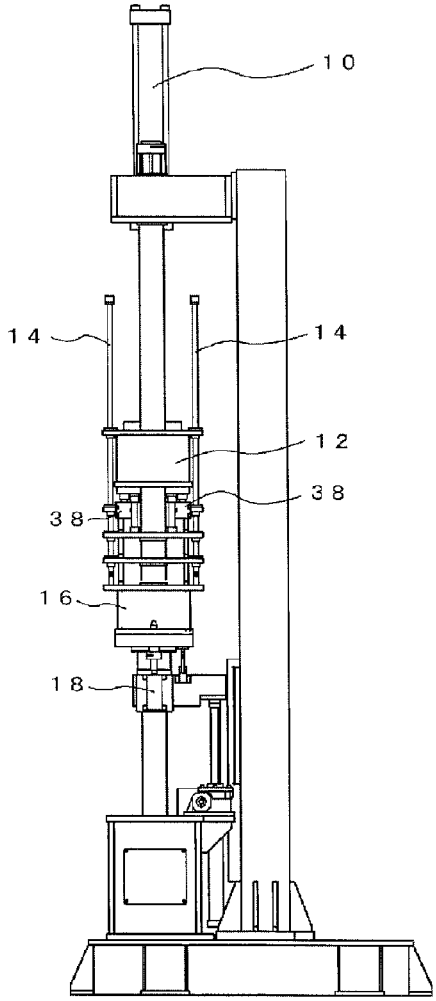

One example of a tube expanding apparatus for heat exchanger tubes provided by the present inventors is depicted in FIG. 1. As depicted in FIG. 1A, the tube expanding apparatus depicted in FIG. 1 is equipped with a pressing plate 12 to which rear end portions of a plurality of mandrels (that have tube expanding billets attached to front end portions thereof) are attached and which is provided so as to be capable of being raised and lowered in the up-down direction by a cylinder apparatus 10 as a driving means, a flare platform 16 that is suspended from the pressing plate 12 by rod members 14, 14 . . . , and balancers 18, 18 which, as depicted in FIG. 1B, are provided below the flare platform 16 and contact the flare platform 16 that has been lowered together with the pressing plate 12 that is lowered by driving the cylinder apparatus 10 so as to support the flare platform 16 at a predetermined position.

Flare punches as depicted in FIG. 2 that are inserted into opening portions of U-shaped heat exchanger tubes, which have been subjected to primary tube expansion by inserting the tube expanding billets, to form flares are attached to the flare platform 16.

Figure 2A:
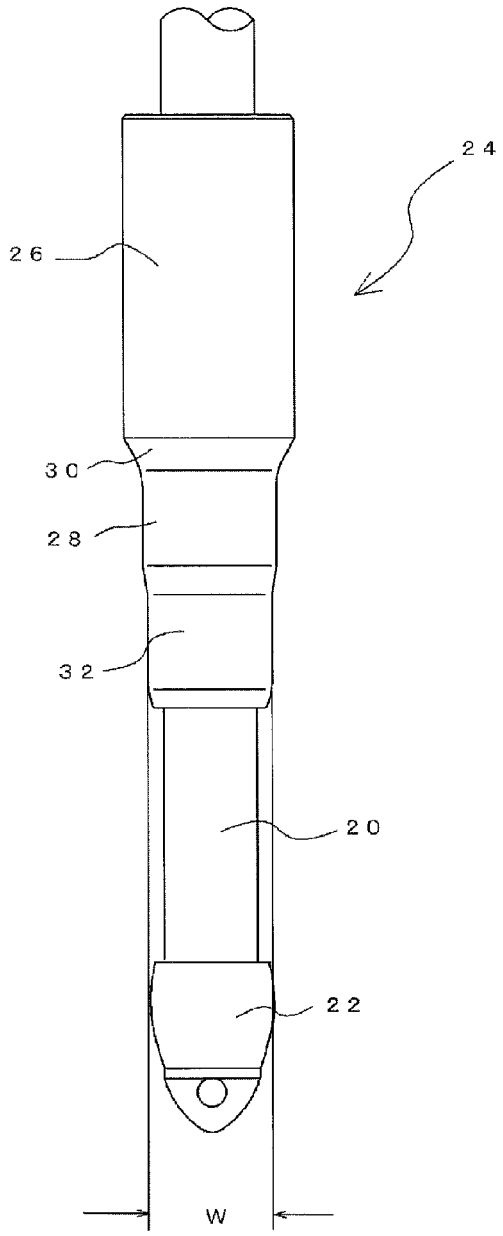
FIG. 2A and FIG. 2B are a front view and a (partially cross-section) front view useful in explaining one example of a flare punch used in the tube expanding apparatus depicted in FIG.
Figure 2B:
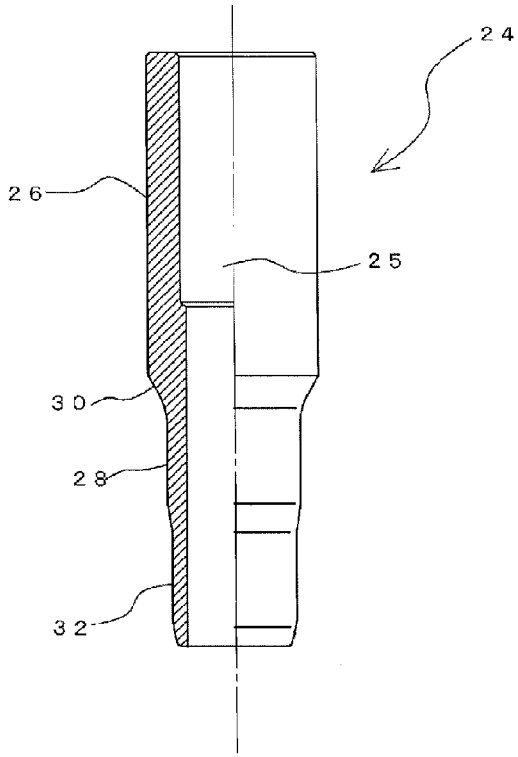

As depicted in FIG. 2B, each flare punch 24 depicted in FIG. 2 is a hollow body that has a through-hole 25 formed along a center axis thereof. As depicted in FIG. 2A, a mandrel 20 that has a tube expanding billet 22 attached to a front end portion thereof is inserted into the through-hole 25.

A guide portion 32 that is formed with an outer diameter that is equal to a maximum outer diameter W of the tube expanding billet 22 is formed on a front end portion of a main portion 26 of each flare punch 24. Toward a rear end of the guide portion 32A, a tapered flare forming portion 30 is formed between a secondary tube expanding portion 28 that is formed with a larger diameter than the guide portion 32 and the main portion 26 that has a larger diameter than the secondary tube expanding portion 28.

Note that by setting the length of the guide portion 32 substantially equal to the secondary tube expanding portion 28, it is possible to easily correct tilting and the like of a heat exchanger tube that has been subjected to primary tube expansion.

Adjustment platforms 36, 36 are movably provided at predetermined positions on screw rods 34, 34 as support structures that extend upward from the flare platform 16 to which a plurality of the flare punches 24, 24 depicted in FIG. 2 are attached.

The position of the adjustment platforms 36, 36 is a position where the pressing plate 12 that has been lowered by driving the cylinder apparatus 10 stops and therefore a position where primary tube expansion of the heat exchanger tubes ends.

Figure 3:
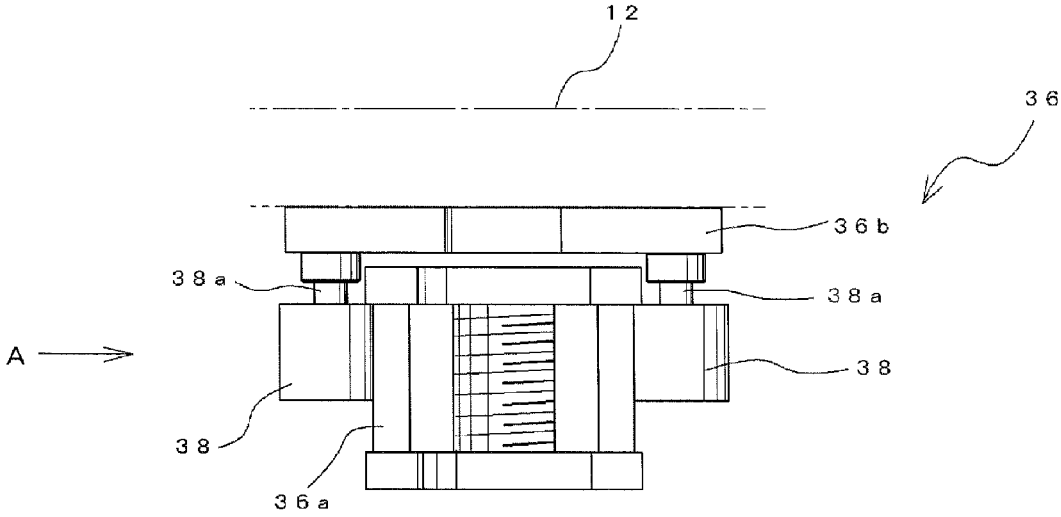
FIG. 3 is a front view useful in explaining an adjustment platform provided in the tube expanding apparatus depicted in FIG. 1.

As depicted in FIG. 3, each adjustment platform 36 is provided with cylinder apparatuses 38, 38 as pressing means on a movable portion 36*a* that meshes with a screw rod 34 and is capable of being positionally adjusted in the up-down direction. A plate member 36*b* that contacts the pressing plate 12 that has stopped being lowered is provided so as to span upper end surfaces of rods 38*a*, 38*a* of the cylinder apparatuses 38, 38.

When the cylinder apparatuses 38, 38 are driven, the pressing plate 12 that has stopped being lowered is pressed upward via the plate member 36*b*.

In this way, when the cylinder apparatuses 38, 38 are driven, the pressing force that presses the pressing plate 12 upward acts via the screw rods 34, 34 as a lowering force that lowers the flare platform 16 against the resistance of the balancers 18, 18. This means that the cylinder apparatuses 38, 38, the plate members 36*b*, and the screw rods 34, 34 construct lowering means that lower the flare platform 16.

Note that the adjustment platforms 36 are depicted in FIG. 1A when looking from the direction of the arrow A depicted in FIG. 3.

As depicted in FIG. 4, when U-shaped heat exchanger tubes 56 are inserted into each of a plurality of collar-equipped holes 52, 52, . . . that are formed in each fin 50 of a fin layer 54 in which a plurality of fins 50, 50, . . . have been stacked and tube expansion is carried out using the tube expanding apparatus depicted in FIG. 1 on the heat exchanger tubes 56 that pass through the fin layer 54, the fin layer 54 into which a plurality of heat exchanger tubes 56 have been inserted is set below the flare platform 16 of the tube expanding apparatus depicted in FIG. 1.

When doing so, as depicted in FIG. 1, hairpin portions 56*b* that protrude from a lower end surface of the fin layer 54 are inserted into U-shaped grooves 58*a* formed in support portions 58 provided on the tube expanding apparatus.

Figure 4A:
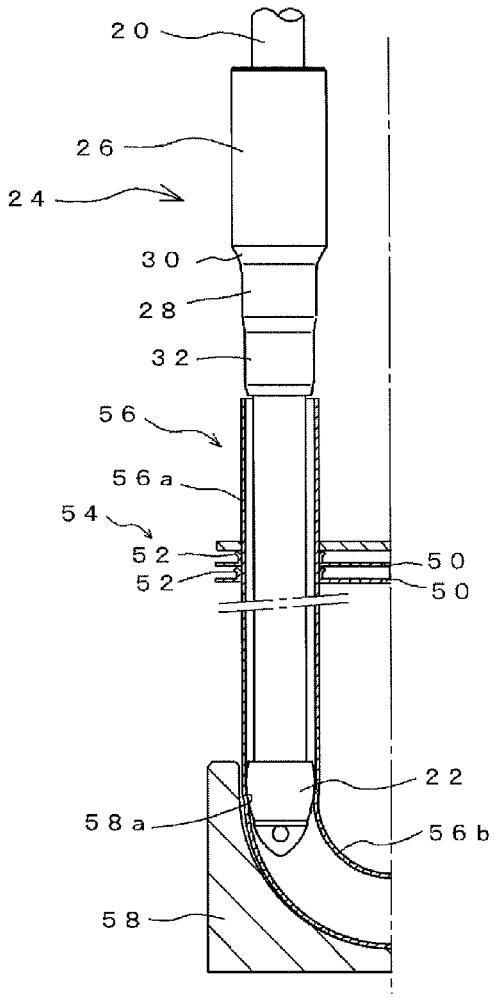
FIG. 4A and FIG. 4B are diagrams useful in explaining a tube expanding method for heat exchanger tubes that uses the tube expanding apparatus depicted in FIG. 1.

As depicted in FIG. 4A, the cylinder apparatus 10 is driven to lower the pressing plate 12 and the tube expanding billets 22 provided on the respective front end portions of the plurality of mandrels 20, 20 whose rear end portions are attached to the pressing plate 12 are inserted into the openings of the heat exchanger tubes 56, 56 . . . that are in an erected state and have been inserted into the U-shaped grooves 58*a* of the support portions 58. By inserting the tube expanding billets 22, primary tube expansion that expands straight portions 56*a* of the heat exchanger tubes 56 is carried out to integrate the heat exchanger tubes 56 and the fins 50.

When primary tube expansion starts, as the pressing plate 12 is lowered, the flare platform 16 is also lowered until the flare platform 16 contacts the balancers 18, 18. A plurality of the flare punches 24, 24, . . . depicted in FIG. 2 are provided on the flare platform 16, and when the flare platform 16 contacts the balancers 18, 18, as depicted in FIG. 3A, the front ends of the flare punches 24 are positioned at the opening portions of the heat exchanger tubes 56 or the vicinity thereof.

The pressing plate 12 is then further lowered and the tube expanding billets 22 carry out primary tube expansion on the straight portions 56*a* of the heat exchanger tubes 56. When the primary tube expansion is carried out, the flare platform 16 is held at a predetermined position by the balancers 18, 18. This means that as depicted in FIG. 4A, the flare punches 24 attached to the flare platform 16 are held in a state where the flare punches 24 are positioned at the opening portions of the heat exchanger tubes 56 or the vicinity thereof.

Next, as depicted in FIG. 4A, the cylinder apparatus 10 is adjusted so as to stop lowering the pressing plate 12 when the tube expanding billets 22 reach the boundaries between the straight portions 56*a* and the hairpin portions 56*b* of the heat exchanger tubes 56 or the vicinity thereof to end the primary tube expansion.

When the lowering of the pressing plate 12 has stopped, the four cylinder apparatuses 38 that are provided on the adjustment platforms 36, 36 whose positions have been adjusted are simultaneously driven to press the pressing plate 12 upward via the plate member 36*b*. The pressing force that presses the pressing plate 12 of the cylinder apparatuses 38 upward acts via the screw rods 34, 34 as a lowering force on the flare platform 16.

The total pressing force of the four cylinder apparatuses 38 provided on the adjustment platforms 36, 36 is adjusted so as to be larger than the pressing force of the balancers 18, 18 that support the flare platform 16. This means that the flare platform 16 is separately lowered while resisting the force of the balancers 18, 18.

Figure 4B:
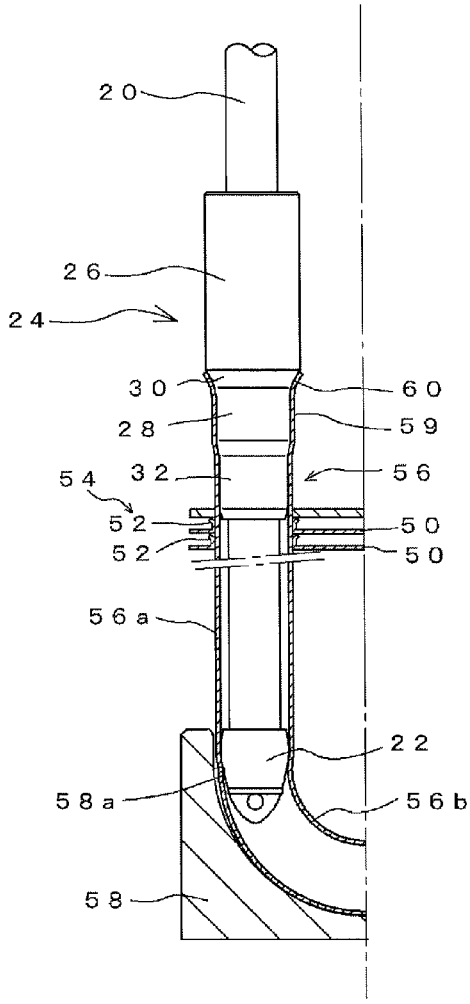
Figure 5B:
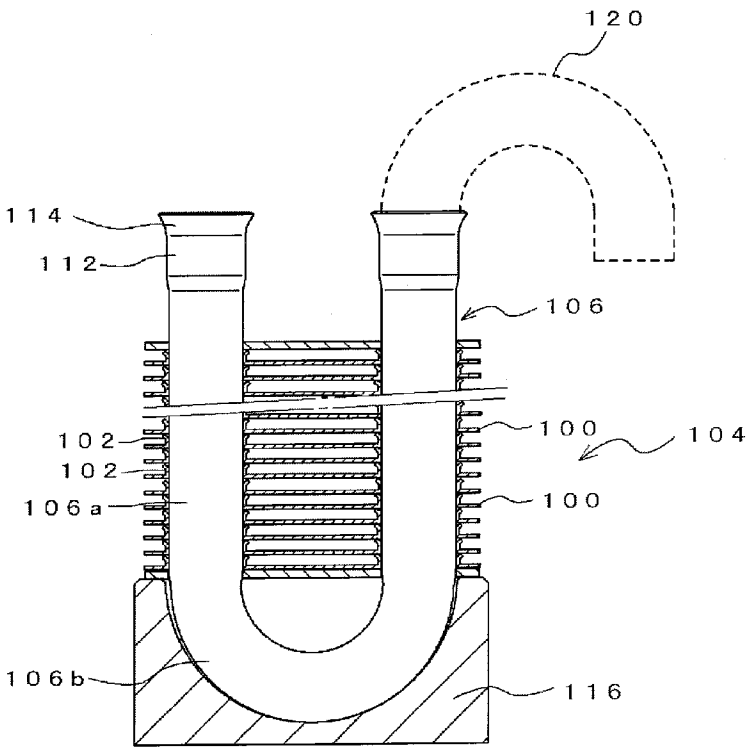
FIG.5B PRIOR ART
FIG. 5A and FIG. 5B are diagrams useful in explaining a typical tube expanding method.
Figure 5A:
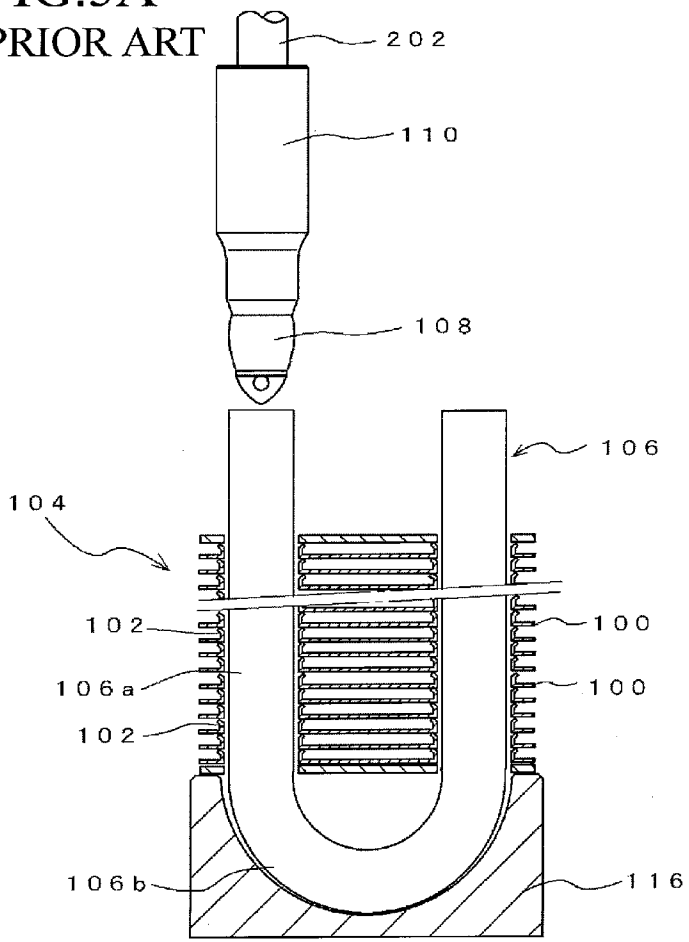
FIG.5A PRIOR ART
Figure 6:
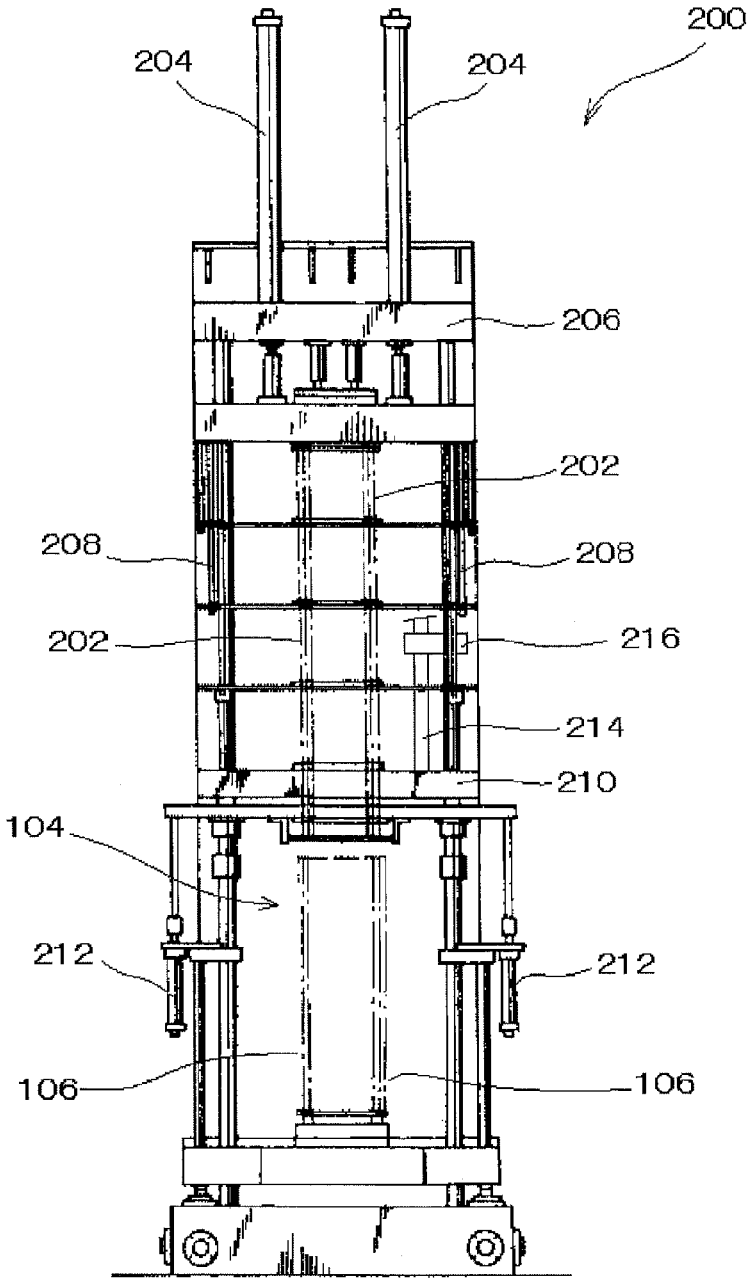
FIG.6 PRIOR ART
FIG. 6 is a front view useful in explaining a conventional tube expanding apparatus.

Accordingly, as depicted in FIG. 4B, while the tube expanding billets 22 that are attached to the pressing plate 12 via the mandrels 20 are being held at the boundaries between the straight portions 56*a* and the hairpin portions 56*b* of the heat exchanger tubes 56 for which the primary tube expansion has ended or the vicinity thereof, the front end portions of the flare punches 24 that are attached to the flare platform 16 are inserted into the opening portions of the heat exchanger tubes 56.

When the front end portions of the flare punches 24 are inserted into the opening portions of the heat exchanger tubes 56, the heat exchanger tubes 56 that have been subjected to primary tube expansion and for which tilting and the like have occurred are corrected by the guide portions 32 so that the center axes of the heat exchanger tubes 56 match the center axes of the flare punches 24.

Next, the secondary tube expanding portions 28 of the flare punches 24 are inserted into the opening portions of the heat exchanger tubes 56 and secondary tube expansion is carried out on the front end portions of the heat exchanger tubes 56 and the vicinity thereof to form expanded-diameter portions 59 whose diameter is larger than the heat exchanger tubes 56 that have been subjected to primary tube expansion.

In addition, flare portions 60 are formed at the front ends of the expanded-diameter portions 59 by the flare forming portions 30 of the flare punches 24.

In this way, when the front end portions of the flare punches 24 are inserted to subject the heat exchanger tubes 56 that have been subjected to primary tube expansion to secondary tube expansion and tertiary tube expansion and thereby form the expanded-diameter portions 59 and the flare portions 60, the tube expanding billets 22 are held at the boundaries between the straight portions 56*a* and the hairpin portions 56*b* of the heat exchanger tubes 56 for which the primary tube expansion has ended or the vicinity thereof and the front end portions of the flare punches 24 are inserted into the opening portions of the heat exchanger tubes 56. This means that the boundaries between the straight portions 56*a* and the hairpin portions 56*b* of the heat exchanger tubes 56 or the vicinity thereof are subjected to only stress that forms the expanded portions 59 and the flare portions 60 due to insertion of the front end portions of the flare punches 24.

Figure 7A:
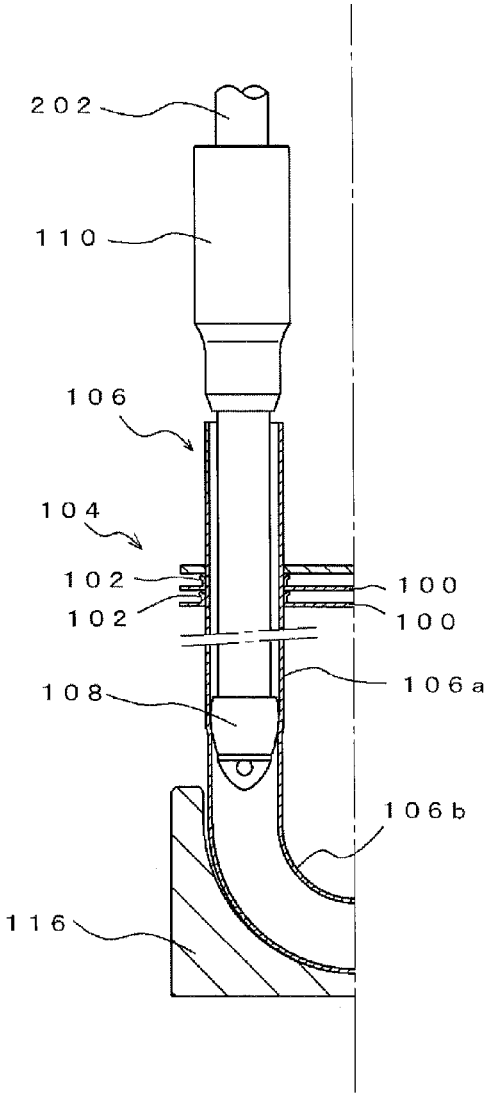
FIG.7A PRIOR ART
FIG. 7A and FIG. 7B are diagrams useful in explaining a tube expanding method that uses the tube expanding apparatus depicted in FIG. 6.
Figure 7B:
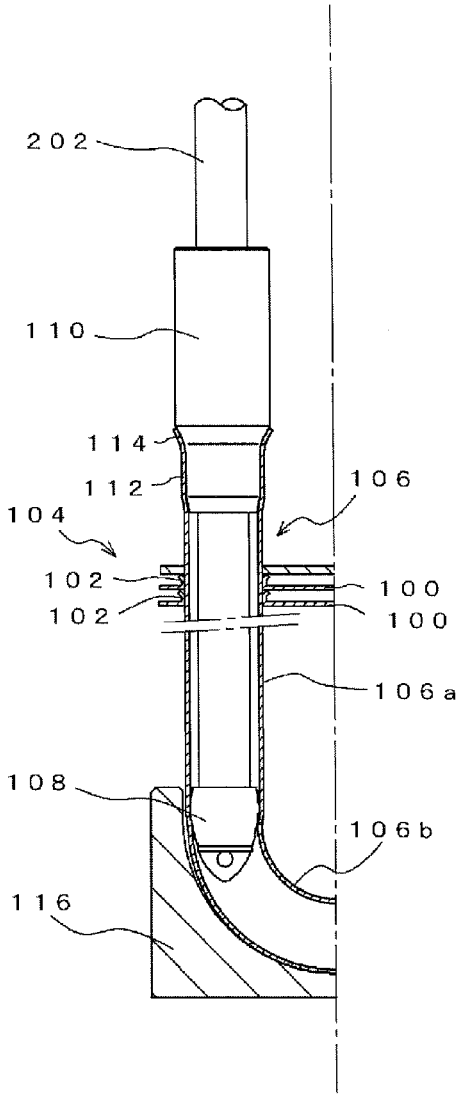
FIG.7B PRIOR ART

Accordingly, during the tube expanding method depicted in FIG. 4, the stress received at the boundaries between the straight portions 56*a* and the hairpin portions 56*b* of the heat exchanger tubes 56 or the vicinity thereof can be reduced compared to the case where stress of primary tube expansion by the tube expanding billet 108 and stress that forms the flares 114 using the flare punches 24 are received in the conventional tube expanding method depicted in FIG. 7.

In addition, in the tube expanding method depicted in FIG. 4, when forming the flare portions 60 by inserting the front end portions of the flare punches 24, the boundaries between the straight portions 56*a* and the hairpin portions 56*b* of the heat exchanger tubes 56 or the vicinity thereof are reinforced by the tube expanding billets 22, and as a result, when forming the flare portions 60 using a heat exchanger tube with a diameter of 6.5 mm that is narrower than in the past, it is still possible to prevent buckling at the boundaries between the straight portions 56*a* and the hairpin portions 56*b* of the heat exchanger tubes 56 or the vicinity thereof.

In this way, tube expansion of the heat exchanger tubes 56 ends, the cylinder apparatus 10 is driven to raise the pressing plate 12 and remove the tube expanding apparatus from the fin layer 54 where the heat exchanger tubes 56, 56 have been integrated with the fins 50, 50.

Although the flare punches 24 where the guide portions 32, the secondary tube expanding portions 28, and the flare forming portions 30 are successively formed from the front end of the main portions 26 are used in the above explanation, flare punches where only the secondary tube expanding portions 28 and the flare forming portions 30 are formed may be used, or flare punches where only the flare forming portions 30 are formed may be used.

What is claimed is:

1. A tube expanding apparatus for heat exchanger tubes comprising:

a pressing plate that has rear end portions of a plurality of mandrels, which have tube expanding billets attached to front end portions thereof, attached thereto and is provided so as to be capable of being raised and lowered in an up-down direction by driving means;

a flare platform that is suspended from the pressing plate by rod members and has flare punches attached thereto, the flare punches forming flare portions in opening portions of U-shaped heat exchanger tubes that have been inserted into each of a plurality of insertion holes formed in respective fins of a fin layer in which a plurality of fins are stacked and that protrude from an upper end surface of the fin layer; and a balancer that is provided below the flare platform, contacts the flare platform when the flare platform has been lowered together with the pressing plate that is lowered by driving the driving means, and supports the flare platform at a predetermined position, wherein the driving means of the pressing plate is adjusted so that when the pressing plate is lowered in a state where the flare platform is supported by the balancers at a predetermined position and the tube expanding billets, which carry out primary tube expansion where straight portions of the heat exchanger tubes are expanded to integrate the heat exchanger tubes with the fins, reach boundaries between the straight portions and hairpin portions of the heat exchanger tubes or a vicinity thereof and the primary tube expansion ends, lowering of the pressing plate stops at a position where the pressing plate does not press the flare platform, and wherein the tube expanding apparatus further comprises lowering means that is operable when the lowering of the pressing plate has stopped, to hold the tube expanding billets at positions where the primary tube expansion ended and lower the flare platform to which the flare punches are attached so as to form flare portions in front end portions of the heat exchanger tubes on which the primary tube expansion has ended;

wherein the lowering means that lowers the flare platform includes:

a support structure that extends upward from the flare platform;

an adjustment platform that is movably provided on the support structure and is positionally adjusted at a position where the lowering of the pressing plate stops or a vicinity thereof; and pressing means that is provided on the adjustment platform and presses the pressing plate, the lowering of which has stopped, upward.

2. A tube expanding apparatus for heat exchanger tubes according to claim 1, wherein each flare punch includes:

a secondary tube expanding portion that carries out secondary tube expansion that further expands a diameter of the front end portion of a heat exchanger tube that has been subjected to the primary tube expansion or a vicinity thereof;

a flare forming portion that is formed closer to a rear end than the secondary tube expanding portion and is inserted into the front end portion of the heat exchanger tube that has been subjected to the secondary tube expansion to form a flare portion; and a guide portion that is formed closer to a front end than the secondary tube expanding portion and, when the flare portion is formed in the front end portion of the heat exchanger tube, is inserted into the heat exchanger tube to positionally adjust the heat exchanger tube so that a center axis of the heat exchanger tube matches a center axis of the flare punch.

3. A tube expanding apparatus for heat exchanger tubes according to claim 2, wherein an outer diameter of the guide portion is equal in diameter to a maximum outer diameter of the tube expanding billet.

4. A tube expanding apparatus for heat exchanger tubes according to claim 1, wherein the balancers are positionally adjusted so that when the balancers contact the flare platform, front end portions of the flare punches provided on the flare platform are located at opening portions of the heat exchanger tubes or a vicinity thereof.

5. A tube expanding apparatus for heat exchanger tubes according to claim 1, wherein the balancers are positionally adjusted so that when the balancers contact the flare platform, front end portions of the flare punches provided on the flare platform are located at opening portions of the heat exchanger tubes or a vicinity thereof.

6. A tube expanding apparatus for heat exchanger tubes according to claim 3, wherein the balancers are positionally adjusted so that when the balancers contact the flare platform, front end portions of the flare punches provided on the flare platform are located at opening portions of the heat exchanger tubes or a vicinity thereof.

* * * * *